United States Patent [19]

Woodfill

[11] 4,026,235

[45] May 31, 1977

[54] JET DRIVE APPARATUS WITH NON-STEERING JET REVERSE DEFLECTOR

[75] Inventor: William L. Woodfill, Fond du Lac, Wis.

[73] Assignee: Brunswick Corporation, Skokie, Ill.

[22] Filed: Apr. 19, 1976

[21] Appl. No.: 678,075

[52] U.S. Cl. ..... 115/12 R

[51] Int. Cl.[2] ..... B63H 11/00

[58] Field of Search ..... 115/12 R, 14, 15, 16; 60/221–222; 114/151

[56] References Cited

UNITED STATES PATENTS

| | | | |
|---|---|---|---|
| 3,756,185 | 9/1973 | Breslin | 115/12 R |
| 3,776,173 | 12/1973 | Horwitz | 115/12 R |
| 3,949,700 | 4/1976 | Baroody | 115/12 R |

*Primary Examiner*—Trygve M. Blix
*Assistant Examiner*—Jesus D. Sotelo
*Attorney, Agent, or Firm*—Andrus, Sceales, Starke & Sawall

[57] ABSTRACT

A jet drive pump is secured to the boat transom and includes a gimbal ring pivoted on a horizontal trim axis and a steering nozzle is pivotally mounted on a vertical pivot axis within the gimbal ring for steering. A trim linkage is connected to position the gimbal ring for trimming of the nozzle. A reversing gate is pivotally mounted on the same trim axis and connected by a mechanical coupling linkage with swivel and pivoting joints to the gimbal ring. The linkage has an axially sliding shift shaft in a rotatable shift lever for rotation about an axis perpendicular to the trim axis. Shaft rotation actuates the coupling linkage to pivot and place the gate in shift position. Trim movement of the ring through the coupling linkage positions the gate and with the sliding shaft moving to hold the present gate position. The shaft extends through a rotatable steering tube. A flexible bearing end of the tube permits limited shaft flexing.

23 Claims, 9 Drawing Figures

JET DRIVE APPARATUS WITH NON-STEERING JET REVERSE DEFLECTOR

BACKGROUND OF THE INVENTION

This invention relates to a marine jet drive apparatus having a non-steering jet reverse deflector apparatus pivotally mounted over a trimmable power jet steering means and particularly to a unique mounting of reverse jet deflector apparatus over the steering means.

Jet drive apparatus for small recreational boats and the like has been developed as alternative drives to the conventional outboard motor and/or inboard-outboard stern drive units. Jet drive apparatus generally includes a pump means for establishing and directing water through a jet nozzle to develop a powerful jet stream which is emitted from the aft end of the boat and establishes forward motion. Steering is accomplished by lateral deflection of the jet stream to either side of a center line position and, thereby, creates a steering force. The jet deflection may conveniently be provided by use of a steering nozzle or deflector forming the aft end of the jet nozzle. The steering deflector pivots about a vertical axis and provides a simple and reliable means of deflecting of the jet for steering purposes. To shift between forward, reverse and neutral, a reverse gate or deflector means is conventionally employed and connected to a suitable remote shift control means. The deflector means is mounted to be selectively positioned over the end of the jet deflector and operable to deflect the jet stream downwardly and forwardly of the boat and thereby create a reverse or backward thrust on the boat. By positioning of the reverse deflector means in an intermediate position, the reverse thrust forces will just balance the forward thrust forces thereby establishing a neutral or stationary boat drive position. Movement of the gate upwardly will uncover the steering deflector thereby increasing the forward thrust forces while simultaneously reducing the reverse thrust forces and effecting the forward movement of the boat. Reverse positioning of the deflecting means further reduces the forward thrust forces while increasing the reverse thrust forces and results in a consequent reverse force movement of the boat.

In conventional practice the steering deflector is also pivoted on a horizontal axis for trim positioning of the drive jet relative to the boat for optimum propulsion efficiency. The reverse gate is mounted on the steering nozzle or deflector to move therewith. As a result, the relative position of the deflecting means overlying the steering nozzle is maintained during trim positioning of the nozzle and the relative strength of the forward and reverse drive or thrust forces does not change. This maintains a neutral drive setting, as the trim setting can vary. This, however, requires that the gate positioning mechanism accommodate the various nozzle movements associated with steering and trim positioning of the nozzle. Generally, flexible push-pull type cables which have a high degree of flexibility such as required by the steering nozzle movement are employed as part of the gate positioning mechanism. Such cables have also been widely employed in conventional propeller drives and are, therefore, known and accepted in the marine trade. However, push-pull cables have certain inherent disadvantages particularly when employed in marine applications. The high moisture environment outside the board creates significant rusting problems. Such cables are also subject to bending and kinking, making operation difficult and unreliable under such conditions, and are subject to breakage. Outside the boat, direct mechanical linkage systems, which include rigid links and interconnected pivot and swivel joints, can be more readily and reliably provided and are therefore desirable.

If the reverse gate means, for example, is directly mounted to a fixed portion of the jet drive apparatus such as the pump housing and made of a sufficient width to completely cover the steering deflector for all trim positions, the flexible cable can be replaced by a fixed linkage such as employed in the trim setting system. However, with the deflection or gate means positioned on the relatively immovable portion of the apparatus, each change in trim position of the steering deflector requires a new positioning of the reverse deflection means to establish the neutral, or other desired drive position. Thus, as the steering deflector is trimmed, its orientation with respect to the jet drive housing changes and, therefore, also changes with respect to the reverse deflection means mounted on such housing. This creates an undesirable condition and may create a highly hazardous condition upon starting of the engine if the reverse deflection means and steering deflector positions do not create a neutral drive state.

The prior art systems have, therefore, employed a gate mounted on the steering deflector in combination with push-pull cable systems for coupling of the gate to a remote shift control means. The push-pull cable systems, of course, require special care and servicing to compensate for the adverse effects of the high moisture environment, as previously discussed. There is, therefore, a significant need for a more reliable revising drive control which can be economically produced and serviced.

SUMMARY OF THE PRESENT INVENTION

The present invention is particularly directed to a marine jet drive apparatus including a reverse deflecting means mounted to a relatively fixed portion of the jet drive apparatus and interconnected by a mechanical shift linkage which continuously and directly adjusts the neutral position of the deflecting means in means. accordance with trim positioning of the jet steering means while permitting repositioning of the deflecting means by a shift control means.

More particularly, in accordance with the present invention, a universal jointed shift positioning or coupling linkage interconnects the deflecting means to a steering means such that the trim movement of the steering means results in a corresponding movement of the reverse deflecting means while the mechanical shift motion resets the coupling linkage to vary the positioning of the deflecting means with respect to the steering means. The shift positioning linkage to the reverse deflecting means includes a mechanical motion different from that placed on the mechanism as a result of following the trim positioning and includes a lost motion type interconnection between a pair of relatively movable members permitting the accurate and free following of trim movement of the steering deflector means.

In a particularly unique and practical embodiment, the coupling linkage may comprise a sliding motion between a pair of link members and a rotary motion about the sliding axis to establish the two motions of the linkage. In particular, a rotatable shift shaft may be secured as the shift input to the coupling linkage such that the rotation of the shaft changes the relative setting of the reverse deflecting means with respect to the steering deflector means. The shaft is slidably mounted within a rotatable shift control mechanism such that when the steering deflector is trimmed the total coupling linkage including the shaft moves, with the shaft sliding within the rotatable shift control mechanism to maintain the preset positioning of the reverse deflecting means with respect to the steering deflector means.

More particularly, in accordance with a preferred and practical embodiment of the present invention, the steering deflector is a cylindrical member mounted within a gimbal ring with a vertical steering axis. The gimbal ring is mounted on a horizontal axis for trim positioning of the steering deflector. A reverse deflecting gate is pivotally mounted on the same horizontal axis. A rigid linkage having swivel joint means interconnects the gate to the gimbal ring such that the trim movement of the gimbal ring is transmitted to and correspondingly positions the gate. A highly satisfactory coupling linkage includes a rigid link interconnected at the opposite ends by universal ball joint connectors to the gate and to a rotating arm rotatably mounted upon the gimbal ring. The rotating arm is mounted with an axis perpendicular to the horizontal pivot axis of the reverse gate means. An operating shift shaft is secured to the pivoting arm and extends therefrom. The operating shaft is slidably coupled to a rotatably mounted shift control hub and transfers rotational forces while permitting independent linear or axial movement of the shaft relative to the input mechanism.

In a highly practical system, the steering mechanism includes a rotating steering tube with the shift rod or shift slidably journaled therein. A flexible bearing and seal means supports the end of the shaft extending from the steering tube to the coupling linkage. The flexible bearing and seal prevents the passing of water upwardly through the steering tube into the boat while also permitting limited shaft deflection with the trim movement of the gimbal ring.

Applicant has found that the present invention provides a simple and highly reliable direct mechanical linkage to a reversing deflecting means while maintaining accurate setting of the reversing gate and particularly permits a fixed neutral setting of the shift control with a direct neutral setting of the reverse deflecting means for all trim positions.

BRIEF DESCRIPTION OF THE DRAWINGS

The drawings furnished herewith illustrate a preferred construction of the present invention in which the above advantages and features are clearly disclosed as well as others which will be readily understood from the following description of such embodiment.

In the drawings.

DESCRIPTION OF THE ILLUSTRATED EMBODIMENT

Figure 1:
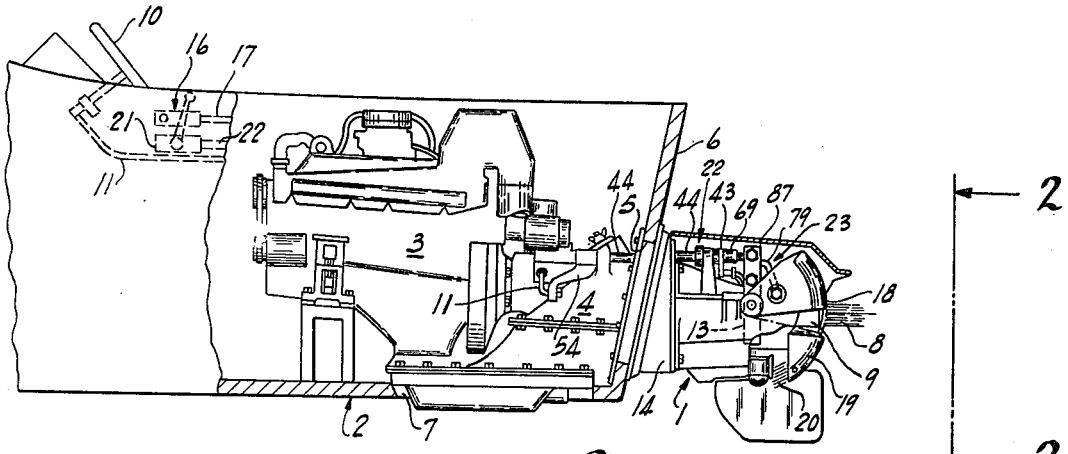
FIG. 1 is a side fragmentary elevational view of a boat provided with a marine jet propulsion drive means secured to the transom of the boat.

Referring to the drawings and particularly to FIG. 1, a marine jet propulsion apparatus 1 is mounted to the aft end of a boat 2 of which only a fragmentary portion is illustrated. The propulsion apparatus 1 generally includes an internal combustion engine 3 suitably mounted within the aft end of the boat 2. The engine 3 is connected to drive a pump unit 4 which projects outwardly through a sealed opening 5 in the boat transom 6. Pump unit 4 has an inlet opening 7 in the bottom of the boat and, in accordance with conventional practice, is adapted to draw the water upwardly through the boat. to pressurize the water and deliver such pressurized water as a high powered driving jet 8 through a jet nozzle unit including a steering deflector 9. A forward mounted steering wheel 10 is connected by a suitable steering cable or linkage 11 extending rearwardly to apparatus 1 and connected as subsequently described for selectively pivoting of deflector 9 about a generally vertical steering axis 12. The lateral positioning of the deflector 9 provides a corresponding lateral movement of jet 8 for turning of the boat to the right or left. The steering deflector 9 in particular is pivotally mounted within a gimbal ring 13 which, in turn, is pivotally mounted to the pump nozzle housing 14. The housing 14 is fixedly mounted to the transom 6 to support the gimbal ring 13 and the deflector 9. The gimbal ring 13 pivots on a generally horizontal or lateral trim axis 15 and permits angular orientation of the deflector 9 about such axis. This permits trim positioning of the deflector for varying the direction of the jet from a generally horizontal position to a raised or lowered trim position in accordance with well-known concepts. Remote control switches 16 may be provided adjacent or at the location of the steering wheel 10 and connected to a suitable powered system including an electrical connection 17 for trim pivoting of the gimbal ring 13. A reverse gate 18 is provided in the illustrated embodiment of this invention and is pivotally mounted on the pump housing 14 which is fixedly attached to the boat. The gate 18 is pivotally mounted on the lateral pivot axis 15 of the gimbal ring 13 and is selectively positioned in overlying relationship to the outermost end of the deflector 9. The gate 18 is operable to redirect all or a portion of the jet 8 downwardly and rearwardly through a reverse nozzle 19 located in the bottom wall of the steering deflector 9.

The reverse nozzle 19 establishes a reversely directed jet 20, generating an opposing propulsion force or thrust with respect to the force of the forward propulsion jet 8. With the reverse gate 18 appropriately located in overlying relationship to the nozzle 9, the force of the reverse jet 20 and the forward jet 8 balance and establish a neutral drive position. The gate 18 thus provides a shift means to move the drive system between forward, reverse and neutral drive or propulsion conditions. A shift control unit 21 is provided adjacent the other controls such as the steering wheel 10 and coupled by a mechanical linkage 22, as hereinafter described, to position the gate 18.

The shift control system generally and preferably includes a neutral interlock means which requires placing of the shift control unit 21 and therefore the gate in the neutral position. When power is applied to the propulsion apparatus, the propulsion forces are not directly created on the boat 2 for purposes of safety and positive control of the boat. In the illustrated embodiment (FIG. 6), a neutral switch unit 22*a* is connected to permit starting only in the neutral position of the shift linkage 22.

The steering motion of the deflector 9 is about a generally vertical axis, and, consequently, steering positioning of the deflector 9 does not affect or change the relative strengths of the reverse and forward jets 20 and 8. However, trim positioning of the deflector 9 about the trim axis 15 will vary the relative strength of the jets 8 and 20 if the gate 18 is held stationary during trim positioning of the deflector 9. In accordance with the illustrated embodiment of the invention, the independently pivoted gate 18 and deflector 9 are coupled by a trim coupling linkage 23 for simultaneous positioning in response to trim positioning of the deflector 9 such that the preset position and particularly the neutral position is continuously maintained with changes in trim. The coupling linkage 23 forms a portion of the shift control linkage 22 and is responsive to reposition the gate 18 in response to actuation of shift control unit 21. A slidable connection therebetween permits the gate 18 to move with the deflector 9 independently of the input side of linkage 22.

The present invention is thus particularly directed to a coupling mechanism or linkage 23 connected to the reverse gate deflecting means and to the shift control means so as to transmit trim positioning of the steerable deflector means to the reverse gate deflecting means and to maintain the preset reverse jet positioning thereof in combination with the separate connection for transmitting motion from the shift setting linkage means to the reverse gate deflecting means independent from the movement of the steering deflector means.

Figure 4:
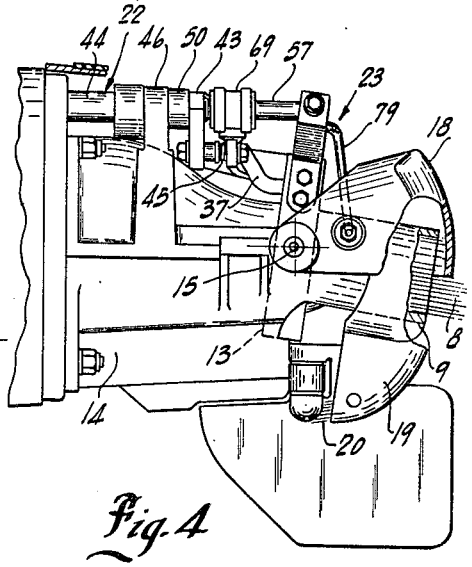
FIG. 4 is a view similar to FIG. 3 illustrating an alternate trim positioning of the jet propulsion drive means.
Figure 3:
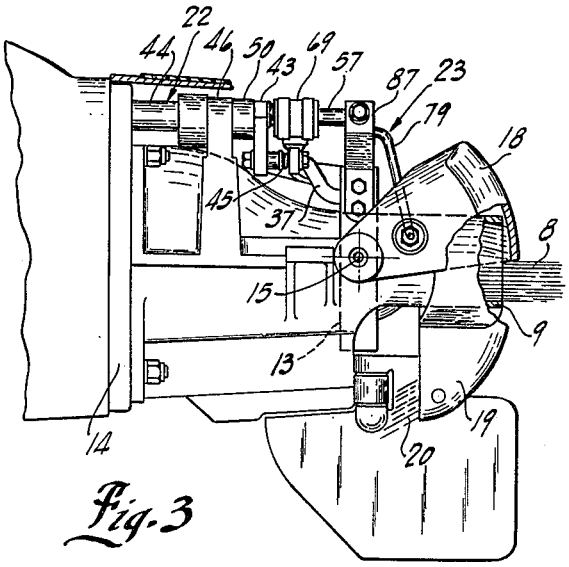
FIG. 3 is a fragmentary side elevational view of the jet propulsion drive means shown in FIGS. 1 and 2 with parts broken away to illustrate mounting details of construction for steering and trimming of the jet drive means.

More particularly and referring to FIG. 4, the pump housing 14 is mounted within the transom opening and includes an impeller unit 24 connected to the internal combustion engine 3. The pump housing 14 extends rearwardly and terminates in a nozzle 25 which is angularly oriented to direct the jet slightly upwardly from the horizontal into steering deflector 9 as shown in FIG. 4. The steering deflector 9 is mounted by the gimbal ring 13 with an inner bell-shaped end telescoped over the outermost end of the pump nozzle 25 for redirecting of the high velocity jet 8 in the desired direction.

The pump housing 14 further includes integrally cast pivot support arms 26 to the opposite side thereof with the outer ends located generally on the horizontal trim axis 15. The arms 26 are interconnected by suitable strengthening web portions to the cone-shaped wall of housing 14. The gimbal ring 13 is generally a ring member located in encircling relation about the outer end of the pump nozzle 25 and inwardly of the outermost ends of the pivot arms 26 and is similarly pivotally mounted to the outer end of such arms. As shown in the top view of FIGS. 2 and 6, a pivot pin 27 is pinned or otherwise suitably affixed within the outer end of the pivot arm 26 and extends outwardly and inwardly on the trim axis. The gimbal ring 13 includes a radial bearing 28 in the adjacent side wall rotatably journaled on the pin 27 with a thrust washer or bearing located between the gimbal ring 13 and the pivot arm 26. The opposite side of the gimbal ring is similarly mounted to the other arm 26 and provides for pivotal movement on the trim axis 15. In the illustrated embodiment of the invention, the trim linkage 17 includes a reciprocal trim control rod 29 slidably mounted within the outer wall portion of the pump housing 14. A connecting link 30 is pivotally connected to the outer end of the trim rod 29 and to a protruding arm 31 on the upper portion of the gimbal ring 13. The push-pull motion of the trim rod 29 is transmitted to and directly sets the positioning of the gimbal ring 13 on the trim axis 15 and correspondingly positions the steering deflector 9 which is mounted within the gimbal ring 13 on the vertical steering axis 12.

Figure 2:
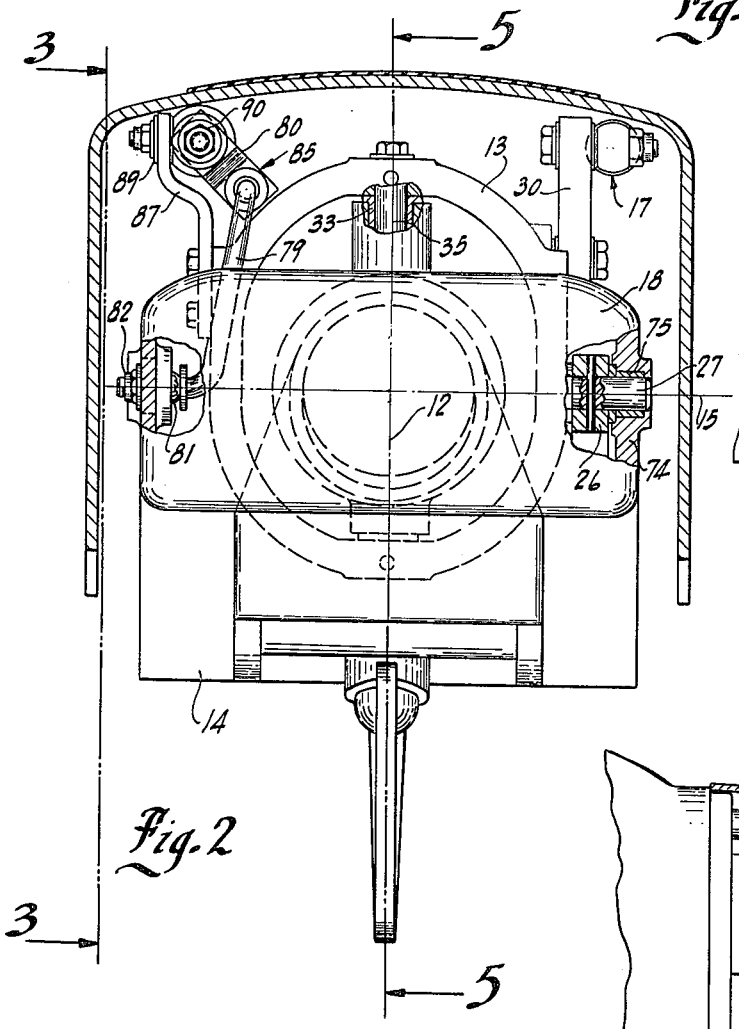
FIG. 2 is an enlarged end view of the jet propulsion drive means illustrated in FIG. 1.
Figure 5:
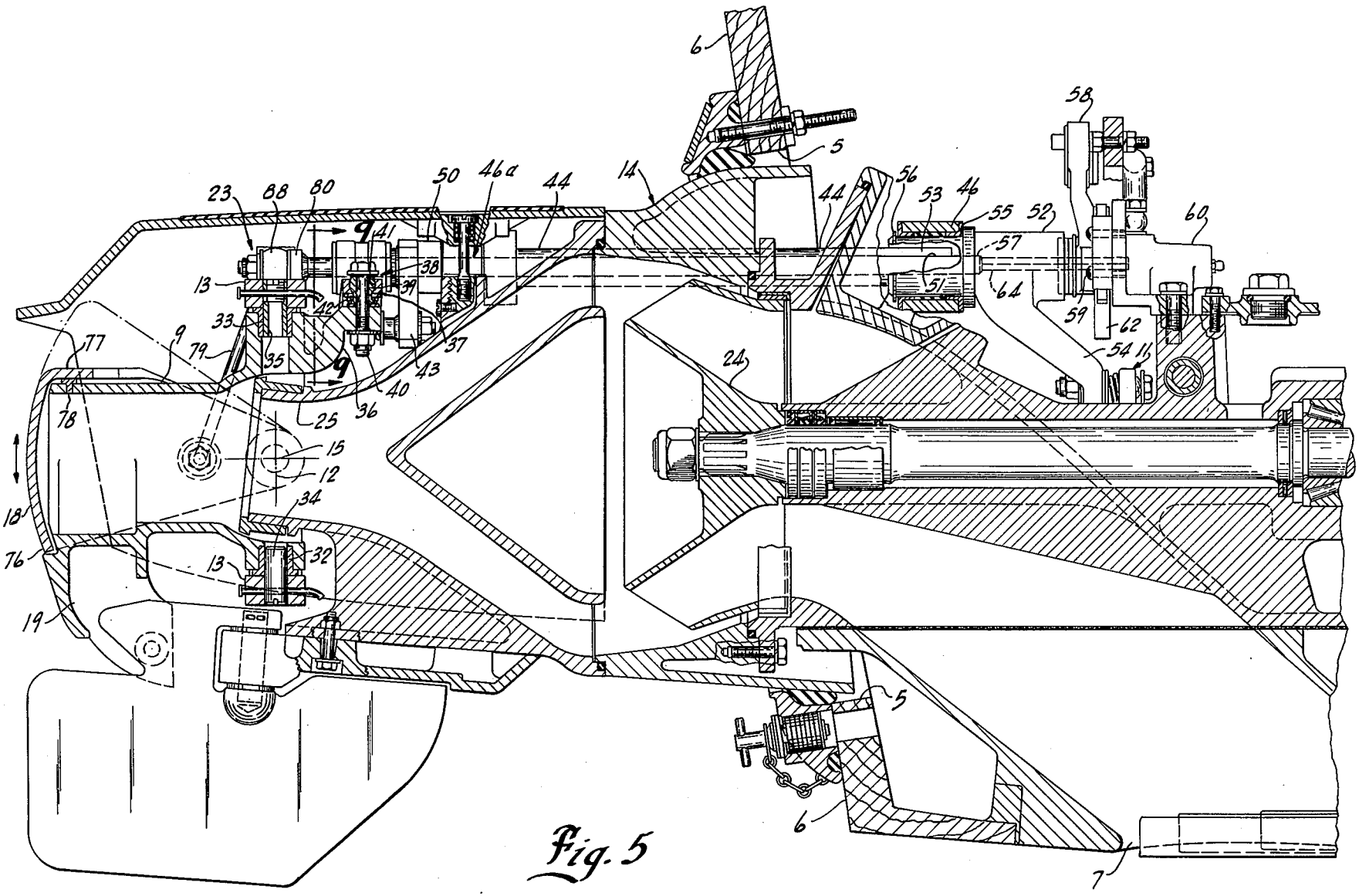
FIG. 5 is an enlarged vertical section generally through the jet drive means and illustrating the steering and shift position control mechanism.

Referring particularly to FIGS. 2 and 5, the steering deflector 9 and particularly the bell-shaped portion is located within the gimbal ring 13. Suitable bearing bushings 32 and 33 are provided on the top and bottom of the bell-shaped portion of nozzle 9 and mate with appropriate pivot pins 34 and 35 secured to the bottom and top walls of the gimbal ring 13. A steering arm 36 is integrally cast to the top wall of the deflector 9 and extends forwardly and upwardly to the boat side of the gimbal ring. A steering link 37 is secured to the top of the arm 36 by a universal pivot joint connector 38 which permits trim positioning of the steering deflector 9 while maintaining of the link in a relatively fixed horizontal position. In the illustrated embodiment, as shown in FIG. 5, the connector 38 includes spherical ball 39 on a bolt 40 and is located within a spherical opening 41 in the link 37. A preload spring 42 is located between the steering arm 36 and the link 37 and continuously urges the link upwardly into a bearing engagement with the spherical ball. The ball 39, in turn, is affixed to the steering arm 36 by bolt 40.

The link 37 extends laterally from the steering arm connector 38 with the outer end thereof turned or offset by ninety degrees and extending beneath a steering tube assembly. The outer end of link 37 is connected to a crank arm 43 firmly affixed to the end of a steering tube 44 which is rotatably mounted within the pump housing assembly. The arm 43 is connected to link 37 by a spring loaded bolt and spherical ball connector 45 similar to that connecting the link 37 to the steering arm 36 of the steering deflector 9. Rotation of the steering tube 44 transmits a turning force to the steering arm 36 for rotating and pivoting of the steering deflector 9 on its vertical pivot axis 12 for steering of boat 2. The connectors 38 and 45 accommodate the trim motion of the gimbal ring 13 without creating undue stresses on the steering linkage.

Figure 6:
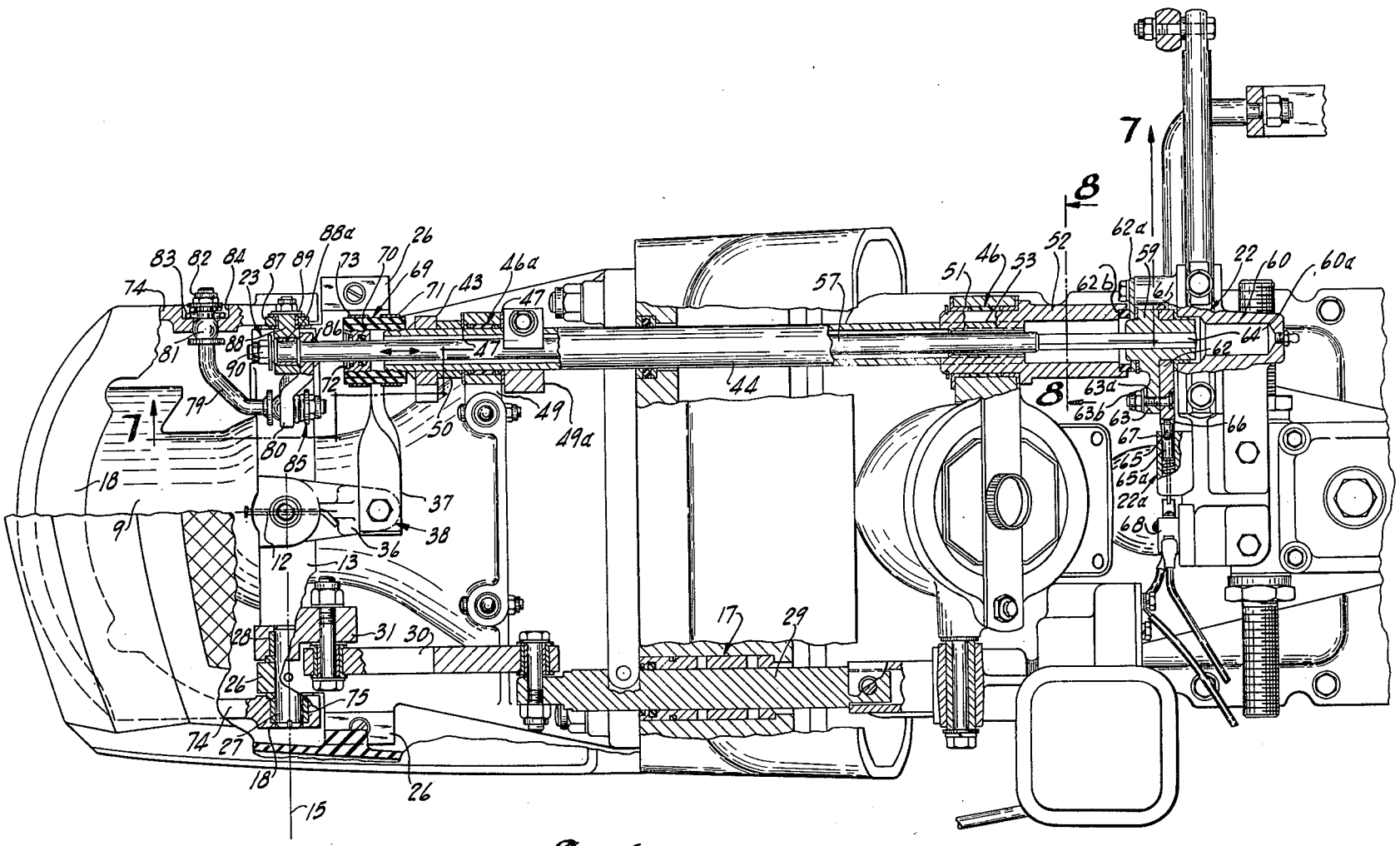
FIG. 6 is an enlarged top plan view with parts broken away in section to more clearly illustrate the details of the trim positioning control and of the steering and shift positioning control mechanism.
Figure 9:
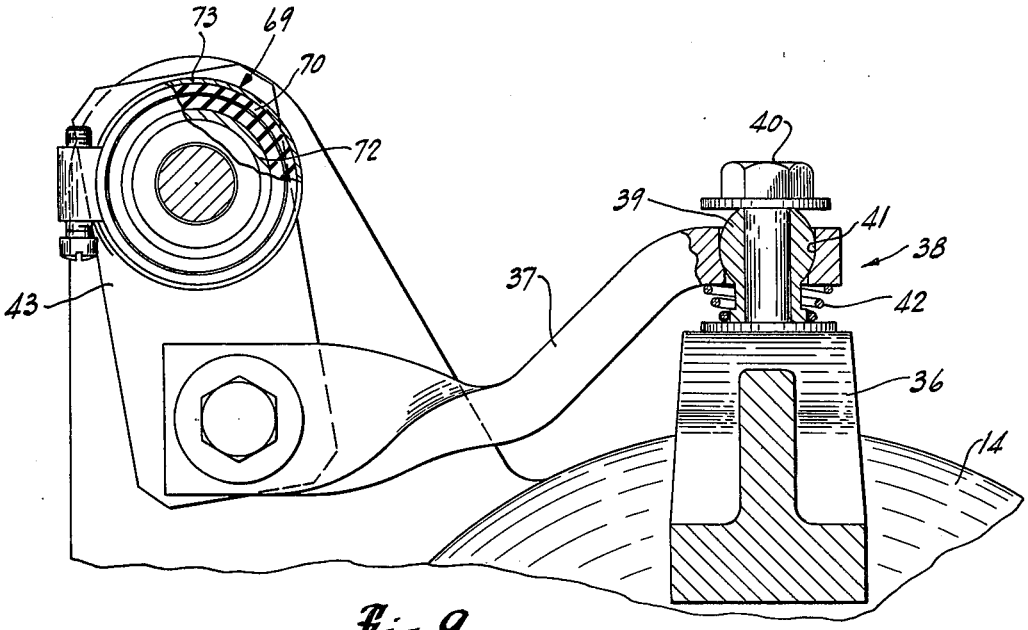
FIG. 9 is an enlarged view of the steering link connection to the steering deflector.

As shown in FIG. 6, the steering tube 44 is rotatably mounted within the housing 14 with suitable radial bearings 46, 46*a*, and thrust bearings 47. The tube 44 is held against said movement by rotatably clamping members on tube 44 abutting bearing units 47. The outer bearing unit 46*a* is located exterior of transom 6 in a bearing bracket 49 on the upper wall of the housing with a collar 49*a* to one side. A spacer 50 is located between the crank arm 43 and the bearing unit 46*a*.

The inner end of the steering tube 44 is slotted on diametrically opposite sides as at 51 and coupled to a correspondingly configured rotating input hub 52 into which it projects, more clearly shown in FIG. 5. Hub 52 is a cylindrical member having oppositely located projections or segments 53 releasably mating with the slots 51 in the assembled relation. The steering hub 52 is rotatably mounted in the inner bearing unit 47 and includes an outwardly projecting lever 54, the outer end of which is connected by the steering control cable or linkage 11 from the steering wheel 10. The inner radial bearing unit 46 is located interiorly of the transom 6 and the hub 52 includes an inner shoulder 55 to one side and a snap-ring 56 to the opposite side.

In the illustrated embodiment of the invention, the shift mechanism includes a shaft 57 which is slidably mounted within the steering tube 44 with the exterior end connected to the shift coupling linkage 22 for selectively positioning of the jet deflecting gate 18. The inner or interior end of shaft 57 is connected with a sliding coupling to a rotatable shift lever 58 rotatably mounted within the boat.

The shift lever 58 includes a hub 59 rotatably mounted within a fixed housing bracket 60, as follows. The hub 59 is a cylindrical member with a central annular enlargement 61 from which lever 58 extends. The one end of hub 59 extends through a cam 62 into the bracket 60 with the enlargement abutting the cam 62. The hub 59 is clamped in position by a mounting washer 62*a* which abuts an outer side of the hub enlargement and is secured to the housing bracket 60. An annular bearing seal 62*b* is located within and projects from the adjacent end of the steering tube hub 52 into abutting engagement with the washer to maintain a complete seal of the shift lever shaft mechanism. The shift lever is connected by suitable mechanical or electrical connection to the remote shift control unit 21.

Figure 8:
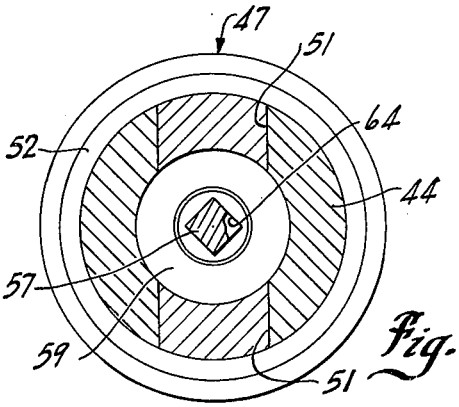
FIG. 8 is a fragmentary view taken generally on line 8 — 8 of FIG. 6 illustrating a steering tube and shift shaft connection to a steering lever and a shift lever.

The shift shaft 57 extends through the hub 59 of the shift lever 58 and is rotatably coupled thereto by forming of the hub opening and the shaft with a square cross section 64, a shown in FIG. 8, to form a spline coupling. Rotation of the shift lever 58 is, therefore, transmitted directly to the shift shaft 57. The shift shaft 57 may freely slide within the square opening of the shift lever 58 during trim positioning of the gate to permit gate movement independently of the position of the shift lever 58, as hereinafter described. An outer cap 60*a* in the housing defines an inner chamber aligned with the hub bearing opening and accommodates the inward movement of the shift shaft 57 and provides for lubrication of the shaft mounting. The shift shaft 57 is, therefore, rotated with hub 59 for positioning of gate 18 between neutral, forward and reverse drive positioning.

The neutral start interlock unit 22*a* includes the cam 62 which is releasably secured to a projecting arm 63 of lever hub 59 by way of a clamping screw and nut 63*a* and 63*b* and rotates therewith. A detent 66 is formed in the periphery of the cam 62. A spring loaded cam follower 65 rides on the edge of cam 62 and moves into the detent 66 with the shift lever 58 placed in the neutral position to form a releasably resilient latch means to resiliently hold the input means in the neutral position. The spring loaded cam follower 65 includes an operating rod 65*a* reciprocally mounted with a support 67 secured to the housing. The rod 65*a* extends through the opposite end of the housing and is coupled to a neutral start switch 68 mounted in the housing. The follower rod 65*a* holds the switch 68 open except when aligned with the detent. The switch 68 is, of course, suitably connected in the starter circuit, not shown, for the internal combustion engine and limits starting of the engine to the neutral setting of the shift control.

The clamping screw 63*a* and nut 63*b* are releasable for affecting synchronizing adjustment of the cam detent position in relationship with the angular input position of shift lever 58, thus allowing variation in neutral power settings and thrust configurations.

The shift shaft 57 extends through the steering tube 44 and extends outward from the exterior end and into operating connection with the gate setting linkage 23. The outer end of the steering tube 44 is provided with a sliding bearing support 69 for the shift shaft 57. Generally, in the illustrated embodiment of the invention, a flexible tube 70 of rubber or the like is clamped as by an enircling clamp band 71 to the outer end of the steering tube 44 and projects outwardly. A bearing and seal unit 72 is secured within the outer end of the flexible tube 70, as by a similar band 73, with the outer end of the shift shaft 57 slidably passing therethrough. The flexible tube 70 permits slight misalignment and movement between the shift shaft 57 and the steering tube 44 without undue loading of the mechanisms as subsequently described.

The outer end of the shift shaft 57 is connected to the linkage 23 to control the setting of the reversing gate 18.

In the illustrated embodiment of the invention, the reversing gate 18 includes a slightly dished front wall which extends laterally to the opposite sides of the steering deflector 9 to mounting side arms 74. The innermost end of the side arms 74 are provided with bushings 75 which are pivotally mounted on the gimbal ring pivot pins 27 secured in the housing pivot arms 26 which extend outwardly of the pump housing 14. The reversing gate 18 is thus pivotally mounted for positioning over the discharge end of the steering deflector 9.

The front wall has a depth slightly greater than the diameter of the deflector 9 and is slightly curved as shown in FIG. 5. In the closed position, the lower end of the gate 18 abuts a rearwardly projecting ledge 76 on the lower portion of the abutting steering deflector 9 to establish a relatively full closure. The jet 8 is therefore deflected downwardly into the reverse opening and nozzle 19. The gate 18 further includes an upper wall 77 which extends over the outer end of the steering deflector 9 which has a resilient bumper 78 beneath such wall to cushion the gate as it is dropped downwardly to the fully closed position.

The gate 18 is positioned in the several drive positions by operating of the interconnecting linkage 23 between the gate 18 and the steering deflector 9, which, in the illustrated embodiment of the invention, is made through gimbal ring 13.

More particularly in the illustrated embodiment of the invention, the connecting linkage 23 includes a shift link 79 which has one end secured to the left sidewall 74 of the gate 18 outwardly of the pivot pin 27 support and which has the other end secured to a shift arm 80 which is welded or otherwise affixed to the shift shaft 57 and clamped to gimbal ring 13. The link 79 is a rigid rod-like member which terminates and is connected by a ball and nut connection to the respective members similar to the steering lever connection. In particular, the outer end of the link 79 is provided with a spherical ball portion 81 which mates with a corresponding spherical portion in the inner side of the gate sidewall 74. A threaded portion projects outwardly through the sidewall 74 and receives a clamping nut 82 with a coil spring 83 located between the exterior of the sidewall and a clamping washer to resiliently hold the spherical ball in place. The exterior of the sidewall 74 is recessed as at 84 to receive and contain the coil spring 83. The link 79 extends laterally inwardly from the sidewall 74 and is bent to extend inwardly and upwardly with the upper end bent to extend over the upper wall of the gimbal ring 13. The upper end is formed with a spring loaded spherical ball and spring loaded connection 85 to the shift arm 80 which includes a gennerally spherical ball recess.

The shift arm 80 is shown as a plate-like member with the shift rod or shaft 57 secured to the opposite end by suitable weld 86. Rotation of the shift shaft 57 rotates the shift arm 80 and repositions the shift link 79 about the axis of the shift shaft. A direct rigid connection is established by the shift link and the universal joint connection such that the gate 18 pivots about its pivot axis on the pivot pins 27 to follow movement of the arm 80. The spherical ball connections allow the arm 80 to rotate to position the link 79 within the connections to the lever and to the sidewall while maintaining the desired movement of the gate 18. This provides the shift positioning of the gate 18 which maintains the preset positioning even though the trim position is changed. The outer end of the shift shaft 57 extends through arm 80 and is secured to the gimbal ring 13 to directly provide movement of the gate 18 with the gimbal ring 13 and thus with the steering deflector 9 during trim positioning of the nozzle unit, as follows.

In the illustrated embodiment of the invention a support bracket 87 is bolted or otherwise secured to the adjacent sidewall of the gimbal ring 13. The upper end of the bracket 87 is apertured and a pivot pin 88 is secured within the opening and extends inwardly over the gimbal ring 13 and is rotatably connected to the shift shaft 57. The pivot pin 88 is illustrated as a shoulder member which extends through an opening in the mounting arm. Suitable thrust and radial bearing washers 89 rotatably mount the pin in the bracket 87. The outer end of the pin 88 is apertured with a radial bearing **88*a* therein and with the pivot shaft 57 extending through the bearing. The pivot pin 88 is located immediately adjacent to the mounted end of the shift arm 80 with a bearing washer 80*a* located therebetween. The outer end of the shift shaft 57 is threaded to receive a clamping nut 90, washer 90*a* and bearing washer 80*b* which firmly interconnects the shaft and pivot pin for movement with the gimbal ring 13 while permitting the shaft 57 to fully rotate within the pivot pin 88, to rotate the shift arm 80 and reposition the gate 18 for directional drive positioning. When the gimbal ring 13 is pivoted about the trim axis, the interconnected bracket 87 rotates therewith. The force is transmitted to the shift shaft 57 through the pivot pin 88. Consequently, the shift shaft 57 slides inwardly or outwardly with respect to the steering tube 44 and the shift lever hub 59** depending upon the trimming direction.

Figure 7:
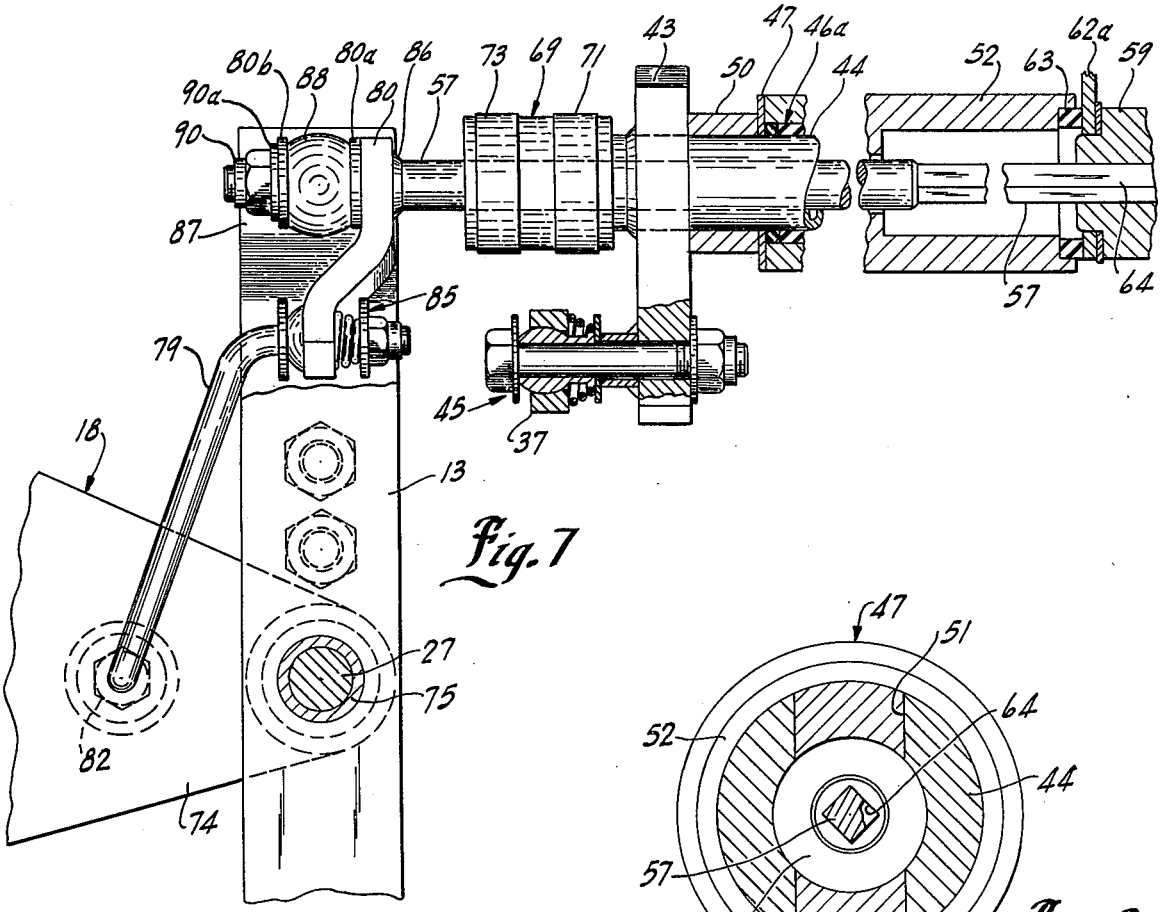
FIG. 7 is an enlarged vertical section through the shift control mechanism.

Thus, referring particularly to FIG. 7, during trim-up positioning, the gimbal ring 13 pivots slightly in a clockwise direction. The upper end of the gimbal ring 13 moves inwardly toward the boat. As a result, the pivot pin 88 bears on the shift arm 80 on the shift shaft 57 and forces it inwardly of the steering tube 44 and the shift lever hub 59. In full trim-up position, shift arm 80 moves into touching or close spacement to the bearing and seal unit 72 clamped onto the outer end of the tube 44. The pivot of the gimbal ring 13 about the fixed axis results in very slight vertical movement of the coupling axis of the pivot pin 88. The shift shaft 57 readily deflects the flexible tube support 69 slightly to accommodate such motion without unduly loading of the shift mechanism. The flexible tubular seal and bearing support 69 of the adjacent end of the shaft 57 also eliminates transmitting of unacceptable strains or stresses onto the steering tube 44 and steering mechanism. In addition, the pin 88 is allowed to freely pivot within the mounting bracket 87 to maintain the essentially linear extension of the shift shaft 57.

Similarly, if the steering deflector 9 is trimmed down, the gimbal ring 13 rotates in an opposite direction as viewed in FIG. 7. As a result, the upper end of the gimbal ring 13 moves outwardly of the steering tube 44 and the shift shaft 57 is pulled outwardly thereof. The bracket 87 pulls the pivot pin 88 and interconnected shift shaft 57 outwardly, with the flexible support accommodating the slight offset. The shift lever 80 which is welded to the shift shaft 57 in turn transmits such trim-related motion of the shift shaft 57 to the rigid link 79 and thus to the gate 18 causing the gate 18 to pivot about the common trim axis with the deflector 9. The degree of pivotal movement is very closely duplicated and consequently the system maintains a precise preset position of the reversing gate 18 for all trim movement. Thus setting of the gate in the neutral position will be maintained, and the operator can safely start the boat at any trim position.

In summary the steering deflector unit 9 is positioned for lateral steering deflection of the jet 8 through a series of suitable rotating arms and joints defining a stable, mechanical linkage. Similarly, the trim positioning is controlled through a suitable direct acting, stable linkage attached to the gimbal ring 13. The trim positioning of the deflector unit 9 is transmitted through the rigid link 79 and the flexible or universal joint connections between gate 18 and the gimbal ring 13 to maintain the present relationship therebetween. The sliding connection at the hub 59 of the shift control lever permits such movement of the gate 18 independently of the setting of the shift control lever 58 to thereby maintain the desired relationship. The system thereby permits the use of the highly reliable and long life mechanical linkages for control of the propulsion means including shifting, trimming and steering.

Various modes of carrying out the invention are contemplated as being within the scope of the following claims, particularly pointing out and distinctly claiming the subject matter which is regarded as the invention.

I claim:

1. A jet drive apparatus for marine craft having jet forming means for forming of a drive jet, a jet steering means mounted on a generally horizontal trim axis, trim positioning means connected to said jet steering means for trim positioning of the drive jet, a shift means adapted to be positioned over the steering means for reversing of the drive jet and developing of a reverse thrust, the improvement in the mounting of the shift means for maintaining a preset drive position of the shift means during trim positioning of the steering means comprising a fixed pivot support means for said shift means having an axis coaxially of the horizontal trim axis, shift control linkage means for selectively positioning of the shift means in overlying orientation with respect to the steering means, a trim coupling means connected to said trim positioning means and to said shift means and establishing movement of the shift means with said steering means to maintain the preset drive position with respect to said steering means, said shift control linkage means including first and second movable members moving relatively in response to movement of the shift means with the trim positioning means to maintain connection to the shift means without repositioning of the shift means relative to the jet steering means.

2. In the jet drive apparatus of claim 1 wherein said first of said relatively movable members is connected to said trim coupling means and whereby said shift control linkage means connects said coupling means to said shift means, and the second of said relatively movable members includes a movement in a plane normal to the movement of the first member.

3. In the jet drive apparatus of claim 1 wherein said first member is common to the trim coupling means and to the shift control linkage means and is slidably mounted relative to said second member, said second member being rotatably mounted and coupled to transmit rotary motion to said first member.

4. The jet drive apparatus of claim 1 including a neutral interlock start means coupled to one of said movable members and limiting starting of the apparatus to a neutral position of the shift means.

5. A marine jet drive for forming a drive jet for a watercraft and having a deflector nozzle means with a horizontal trim pivot means for trimming of the drive jet, a reversing gate means, a pivotal mount for said gate means located coaxially of the trim pivot means, trim coupling linkage means coupling the gate means to the nozzle means for pivoting of the gate means with the nozzle means in response to trimming of the nozzle means, and shift control linkage means connected to said gate means and having an input means for positioning of the gate means relative to the nozzle means and including relatively movable linkage members connected between the input means and the gate means for establishing movement of the gate means independently of the input means only during the trimming of the deflector nozzle means.

6. The marine jet drive apparatus of claim 5 wherein said linkage members include one member coupled to move with the gate means and a second member coupled to move with the input means, and a resilient latch means coupled to the input means to resiliently hold the input means in a selected position.

7. The marine jet drive apparatus of claim 5 including a pump housing having a fixed mounting means adapted to be fixedly secured to the transom of the watercraft, a gimbal ring means having said horizontal trim pivot means attached to said housing, said deflector nozzle means having a vertical steering pivot means attached to said gimbal ring means for horizontally deflecting of said jet, said trim coupling linkage means connected to said gimbal ring means for pivoting therewith about the horizontal trim pivot means, said relatively movable linkage members of said shift linkage means including a rotating lever having an input member and a transfer member slidably mounted in said input member with a rotatable connection for maintaining rotating force transmission between the rotating lever and the gate means, said transfer member being connected to said trim coupling linkage means and establishing force transmission of trim position forces from the deflector nozzle means to said gate means and isolation of the deflector nozzle means from the shift forces.

8. A marine jet drive, a support having means for attachment to the boat, gimbal ring means having horizontal pivot means and a vertical pivot means, one of said pivot means being connected to the support, a deflector means secured to the other of said pivot means whereby said deflector means is pivotally mounted for positioning on both the horizontal pivot means and the vertical pivot means, gate means having a horizontal pivot axis coaxially of the horizontal pivot means, coupling linkage means including a rigid link and pivotal joint means coupling the gate means and the deflector means for pivoting of the gate means with the deflector means in response to trimming of the deflector means, and a shift means connected to said gate means and having an input means for positioning of the gate means relative to the deflector means and including relatively movable members connected between the input means and the gate means for establishing movement of the gate means independently of the input means during the trimming of the deflector means.

9. A marine jet drive apparatus, comprising a pump housing with a support means adapted to be fixedly secured to the transom of a watercraft and forming a rearwardly directed drive jet, a gimbal ring means having a horizontal trim pivot means attached to said housing, a jet deflector means having a vertical steering pivot means attached to said gimbal ring means for horizontally deflecting of said jet, means connected to said gimbal ring means for pivoting thereof about the horizontal trim pivot means, a reversing gate means pivotally mounted to said housing on said trim pivot means for pivotal movement into overlying relationship to said jet deflector means for reversing of the jet, a shift input lever mounted for opposite movement between two positions, a shift linkage from said shift input lever to said reversing gate means for positioning of the reversing gate means to establish a forward and a reverse drive jet and an intermediate position to establish neutral drive jets, said linkage including a pair of movable elements having interlocking means maintaining force transmission and a corresponding first movement with the input lever and the reversing gate means in response to movement of the input lever between said two positions and movable relative to each other in a direction normal to that of the first movement, and a trim coupling linkage between said reversing gate means and the jet deflector means and establishing force transmission of trim position forces from the jet deflector means to said reversing gate means with operative separation of the jet deflector means from the shift linkage.

10. In the marine jet drive apparatus of claim 9 wherein said shift input lever is rotatably mounted, said pair of movable elements includes a shift shaft connected to said shift input lever by a sliding connection whereby rotational movement of the shift input lever is transmitted to said shaft, mechanical transfer means secured to the shift shaft and to the reversing gate means and including universal ball joint means for transmitting of rotation of the shift shaft to the gate means to reposition the gate means relative to the jet deflector means.

11. The jet drive apparatus of claim 10 and wherein said trim coupling linkage includes a pivotal support means connected to the gimbal ring means for movement therewith and connected to the shift shaft to move the shaft axially and directly positioning of the reversing gate means with said jet deflector means.

12. The jet drive apparatus of claim 10 wherein said shift linkage includes a splined shaft slidably mounted in a tubular member with an interconnecting sliding coupling and one of which is connected to the shift input lever for establishing shift movement of the shift linkage.

13. The jet drive apparatus of claim 12 including means to lubricate said sliding coupling.

14. The jet drive apparatus of claim 10 including a neutral interlock means resiliently releasably holding said shift input lever in a neutral setting.

15. The jet drive apparatus of claim 14 including a neutral start switch, a switch operator coupled to said interlock means and operable to actuate the switch in the neutral setting of the input shift lever.

16. In the marine jet drive apparatus of claim 9 wherein said shift input lever is rotatably mounted, said shift linkage includes a shift shaft connected to said shift input lever for rotation with said shift input lever by a sliding coupling, a shift arm secured to the shift shaft, a rigid link having universal ball joint connection means at each end connected one each to the shift arm and to the gate means for transmitting of rotation of the shift shaft and arm to the gate means, said trim coupling linkage includes a pivotal support means connected to the gimbal ring for movement therewith and connected to the shift shaft to move the shaft axially and thereby move the shift arm and rigid link for respositioning of the reversing gate means with the deflector means.

17. The marine jet drive of claim 16 wherein said trim coupling linkage includes a bracket on said gimbal ring, said pivot support means includes a pivot pin rotatably secured in said bracket and having an opening, said shift shaft extended through said opening, clamp means to the opposite sides of the pivot pin and rotatably securing the shift shaft to the pivot pin.

18. The marine jet drive of claim 16 wherein said shift arm is secured abutting said pivot pin to form one side of the clamp means.

19. In the marine jet drive apparatus of claim 16 including a steering tube rotatably mounted to and having an outer end adjacent the gimbal ring means, a seal and bearing unit including a flexible tube secured to the outer end of the steering tube and having a shaft bearing secured within the outer end of the flexible tube, said shift shaft rotatably mounted in said steering tube and extending outwardly from the opposite ends with one end rotatably and slidably supported in said bearing unit and the opposite end slidable in and coupled to rotate with the shift input lever.

20. The marine jet drive apparatus of claim 19 wherein a support hub is mounted in spaced alignment with the inner end of the steering tube, said shift input lever having a shift hub mounted in said support hub and extends into abuttment with the inner end of said steering tube.

21. The marine jet drive apparatus of claim 20 including a neutral start interlock switch means, a cam member secured to the shift hub, and a cam follower riding on said cam member and coupled to actuate said switch means for limiting starting of the drive apparatus to a neutral position of the gate means.

22. In the marine jet drive apparatus of claim 21 wherein the cam member is releasably secured to the shift hub to allow for adjustment of the relationship of said cam member to said shift hub.

23. In the marine jet drive apparatus of claim 9 wherein said pump housing includes a pair of oppositely located pivot arms, trim pivot pins secured to said arms and to said gimbal ring means to form said horizontal trim pivot means, said means connected to said gimbal ring means being a trim setting linkage including rigid links and pivotal joints connected to said gimbal ring means for pivoting thereof about the horizontal trim pivot means, said gate means having pivotal mounting sidewalls connected to said trim pivot pins, a steering means connected to said deflector means and including a rotatably mounted tube, said shift linkage including a shift shaft rotatably mounted in said tube, said shaft having an inner square end extending outwardly of said tube, said shift input lever having a hub with a square opening receiving said shaft to permit relative movement of the shaft while maintaining force transmission from the shift input lever to the shaft, said shift linkage including an arm secured to said shaft in spaced relation to the outermost end of the tube, a rigid link having a universal pivot connection means on each end and secured at one end to the outer end of said arm and at the opposite end to the sidewall of said gate means, said trim coupling linkage includes a pivot support arm on said gimbal ring means, a pivot pin pivotally mounted in the pivot support arm with a pivot axis parallel to the trim axis and having an opening through said pin perpendicular to said pivot axis, the outer end of said shift shaft extending through said opening, and clamp means secured to the outer end of said shaft and said arm being located adjacent the opposite side of the pin whereby the shaft and arm move axially in response to trim positioning of the gimbal ring means and thereby correspondingly positions the rigid link and interconnected gate means.

* * * * *